United States Patent [19]

Krein

[11] Patent Number: 4,516,906

[45] Date of Patent: May 14, 1985

[54] FREE STANDING, WATERPROOF LINING FOR TRUCK INDUSTRY

[76] Inventor: Reuben Krein, 812 N. 2nd, Fort Smith, Ark. 72903

[21] Appl. No.: 502,696

[22] Filed: Jun. 9, 1983

[51] Int. Cl.[3] ..... B65D 88/12

[52] U.S. Cl. ..... 414/786; 414/373; 220/85 B; 220/462; 296/39 R; 105/355; 493/217; 53/175; 53/385; 244/118.1

[58] Field of Search ..... 414/293, 373, 398, 786; 220/85 B, 410, 461, 462; 296/39 R, 39 A; 105/238 R, 355, 359; 493/217, 907; 53/175, 385, 570; 52/2; 114/73, 75; 244/118.1

[56] References Cited

U.S. PATENT DOCUMENTS

| | | | |
|---|---|---|---|
| 2,712,797 | 7/1955 | Woehrle et al. | 296/39 |
| 3,167,209 | 1/1965 | Jones | 220/461 |
| 3,456,834 | 7/1969 | Paton | 220/461 |
| 3,756,469 | 9/1973 | Clark et al. | 105/423 X |
| 3,951,284 | 4/1976 | Fell et al. | 296/39 X |
| 3,980,196 | 9/1976 | Paulyson et al. | 296/39 X |
| 4,124,136 | 11/1978 | Bjelland et al. | 105/423 X |
| 4,186,845 | 2/1980 | Podd | 220/461 |
| 4,441,627 | 4/1984 | Takeuchi | 220/461 |
| 4,461,402 | 7/1984 | Fell et al. | 220/85 B X |

FOREIGN PATENT DOCUMENTS

| | | | |
|---|---|---|---|
| 7501558 | 2/1975 | Netherlands | 220/85 B |

OTHER PUBLICATIONS

Container News, May 1983, "Dry Van Process Used to Ship Apples" by Bruce Johnson, pp. 68–70.

*Primary Examiner*—Robert J. Spar
*Assistant Examiner*—Ken Muncy
*Attorney, Agent, or Firm*—Head, Johnson & Stevenson

[57] ABSTRACT

A method of installing a continuous moisture proof essentially disposable film liner within a conventional cargo trailer to protect moisture sensitive cargo during shipment. A polyolefin bag is inflated directly into an empty tractor trailer by attaching the lower edge of the bag opening along the bottom of the doorway of the trailer and blowing a gentle stream of air into the bag as sufficient tension is applied to the upper edge and surface of the bag to direct the air to the rear of the trailer. In this manner, the bag inflates from the rear of the trailer forward, thus pushing the air trapped between the bag and the inside of the trailer out the open doorway without the bag exiting the trailer. Once the bag is properly inflated and in contact with the inside of the trailer, it has been found that it tends to remain in place for sufficient time to load the cargo, even without continued use of the blower.

8 Claims, 6 Drawing Figures

FREE STANDING, WATERPROOF LINING FOR TRUCK INDUSTRY

BACKGROUND OF THE INVENTION

1. Field of the Invention

This invention relates to a method of installing a free standing, waterproof lining in a truck trailer, cargo container or the like. More specifically, this invention relates to an air assisted method of inserting a disposable polyolefin bag or film liner into a semi-trailer during loading of the trailer such as to protect moisture sensitive cargo.

2. Description of the Prior Art

The basic concept of providing a semi-truck trailer with a liner and ancillary support equipment has been generally proposed in the past for various reasons. For example, in U.S. Pat. No. 2,712,797 a bag like flexible container is disclosed mounted in a dump truck trailer wherein supporting means for collapsing the flexible container is provided such that the trailer can be used for bulk haulage of pourable material as well as for general hauling. U.S. Pat. No. 3,756,469 discloses a flexible liner used in a hopper vehicle, again where the flexible liner is supported within the trailer such that it is collapsible, allowing the trailer to be converted to general hauling. Other specialized applications for open topped trailer liners have been proposed such as in U.S. Pat. No. 4,186,845 wherein a foamed base sheet with polymeric top sheet is proposed for creating a tub within a trailer and U.S. Pat. Nos. 3,980,196 and 4,124,136 disclose flexible liners with framework and bulk head that essentially convert the trailer into a container for bulk cargo transport. Similarly, U.S. Pat. No. 3,951,287 discloses a flexible liner that is supported within a conventional semi-trailer by stretchable connectors along the trailer sidewalls that essentially convert the trailer to bulk material shipping.

In contrast to the prior art concept of using a flexible liner for bulk handling, theoretically there are other applications for use of a liner within a trailer provided such liner would be intrinsically extremely inexpensive, be readily and conveniently installed without essentially any down time or significant additional labor costs and provided that no other significant health hazard or risk is associated with its use. For example, it is known and generally tolerated in the trailer industry that certain types of common and ordinary goods statistically incur significant water damage associated with conventional transportation procedures independent of continuing efforts to prevent such shipping damage. In particular, moisture damage to cigarette and other tobacco products during transportation is known to be a troublesome problem in the industry, as is moisture and water damage to various paper products and paper related articles directly attributable to leaks in the semi-trailer. Although damages associated with such occurrences can be considered a significant statistical risk and cost from an insurance industry viewpoint, the actual effectiveness of correcting the problem by conventional methods (e.g., better packaging, sealing leaks in the trailer, etc.) is cost prohibitive relative to insuring the risk. In principle, an essentially disposable liner that could be selectively installed in a semi-trailer on an as needed basis would represent an ideal solution. To the best of the present inventor's knowledge, no one has proposed a method of installing an essentially stand alone, disposable polyolefin film bag that could be installed in a semi-trailer on short notice and enclose the entire cargo.

SUMMARY OF THE INVENTION

In view of the problems associated with shipping certain moisture sensitive cargo, I have discovered a method of installing a continuous film liner within an enclosed cargo trailer such as to serve as a moisture barrier protecting the cargo to be shipped within the trailer comprising the steps of:

(a) providing an enclosed cargo trailer having doors at one end wherein the trailer is intended to be used to ship moisture sensitive cargo;

(b) providing a deflated moisture proof film bag of dimensions slightly in excess of the interior dimensions of the trailer and having an opening in the film bag that corresponds to the doorway of the trailer;

(c) placing the deflated bag within the empty trailer such that the opening of the bag is located at the doorway of the trailer prior to placing cargo within the trailer;

(d) temporarily attaching the lower edge of the bag opening to the lower edge of the doorway such that the bag is directed into the interior of the trailer;

(e) physically restraining the upper edge of the bag opening from making contact with the upper portion of the trailer and trailer doorway;

(f) directing and blowing a stream of air into the bag opening while physically restraining the upper edge of the bag opening according to step (e) such that the air is directed towards the back end of the trailer;

(g) maintaining sufficient tension on the upper edge of the bag opening while the blowing of air into the bag continues such as to direct all of the air to the far end of the trailer thus causing the inflating bag to make continuous contact with the interior of the trailer from the frontmost portion of the trailer forward to the trailer doorway, thus displacing the air between the inflating bag and the interior of the trailer out the trailer doorway; and (h) temporarily attaching the bag opening of the inflated bag to the perimeter of the trailer doorway such as to allow cargo to be loaded within the trailer and inflated liner.

It is an object of the present invention to provide a method of installing an inexpensive thin film liner within a transportation or storage container such that the liner will protect cargo loaded into the container. It is a further object that this liner be a disposable polyolefin bag that remains essentially free standing during loading, wraps entirely around the cargo and seals during transportation or storage and is easily disposed of after use. Fulfillment of these objects and the presence and fulfillment of other objects will be apparent upon complete reading of the specification and claims taken in conjunction with the drawings.

DESCRIPTION OF THE PREFERRED EMBODIMENTS

Figure 1:
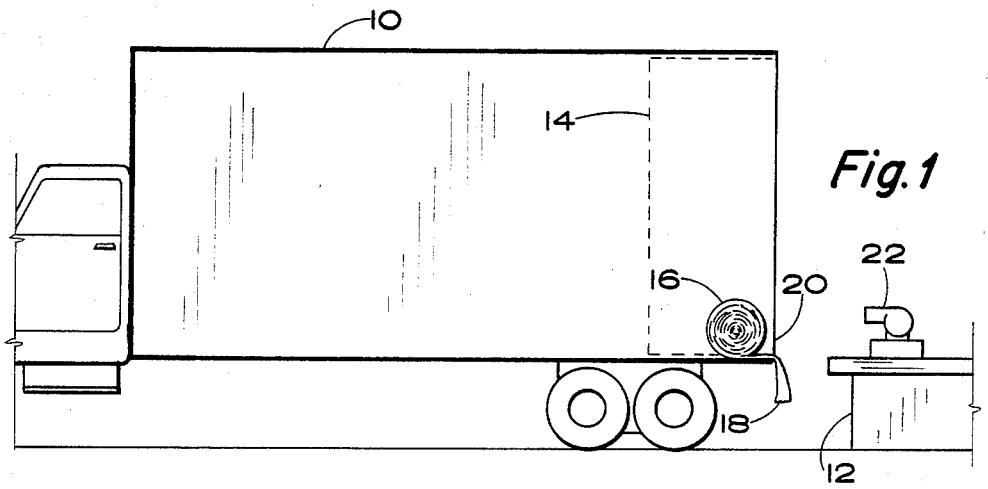
FIGS. 1 through 3 are partial cross-sectional views illustrating the sequential steps associated with the method of the present invention for placing a stand alone, moisture proof liner in a semi-trailer.

The method of installing a waterproof liner according to the present invention can perhaps be best explained and understood by reference to the drawings. FIG. 1 illustrates a conventional semi-tractor trailer 10 backed up to a loading dock 12 with rear doors 14 of the trailer 10 opened for installation of the liner 16. As illustrated, liner 16 is initially in a deflated state and, in this embodiment, rolled up in a tight coil. The liner 16 is essentially a large plastic bag or inflatable bladder wherein the opening 18 of the bag is positioned at the doorway 20 of the trailer. The bag is then unrolled or unfolded and stretched out such that it extends along the floor of the trailer with the closed end at the front of the trailer and the open end of the bag extending out the doorway. An air blower 22 is positioned on the dock 12 and directed toward the front of the trailer 10 such as to be turned on later when inflating the liner 16.

Figure 2:
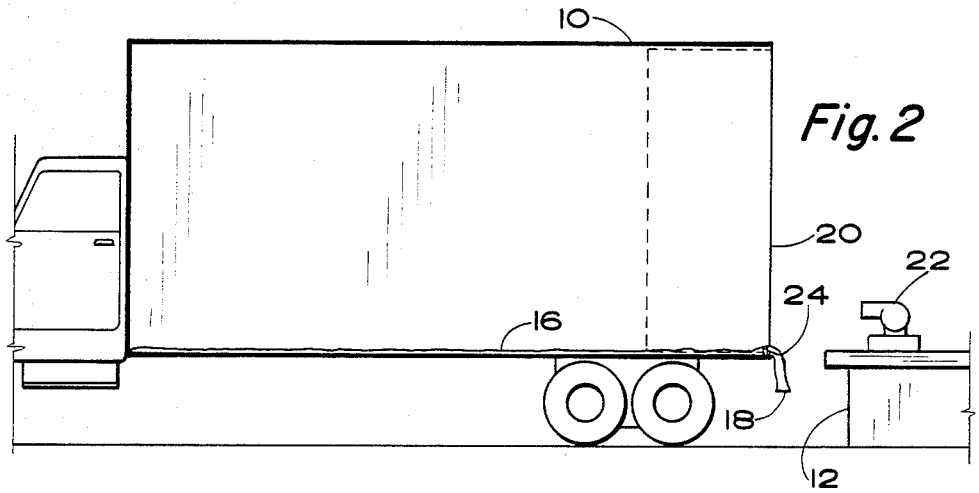

FIG. 2 illustrates liner 16 fully extended in the trailer with the lower portion of the liner bag opening 18 being retained to the lower edge of the trailer doorway 20 by a tension bar 24. Various alternative methods of attaching at least the lower edge of the liner bag to the bottom of the trailer doorway can be employed in conjunction with the method of the present invention. For example, the bag can be temporarily taped, tacked or glued or a weight can be placed on the inner lower edge of the bag or any conventional fastening mechanism can be used in attaching the bag to the lower edge of the trailer. This attachment can also be used partially up the sidewalls if appropriate.

Figure 3:
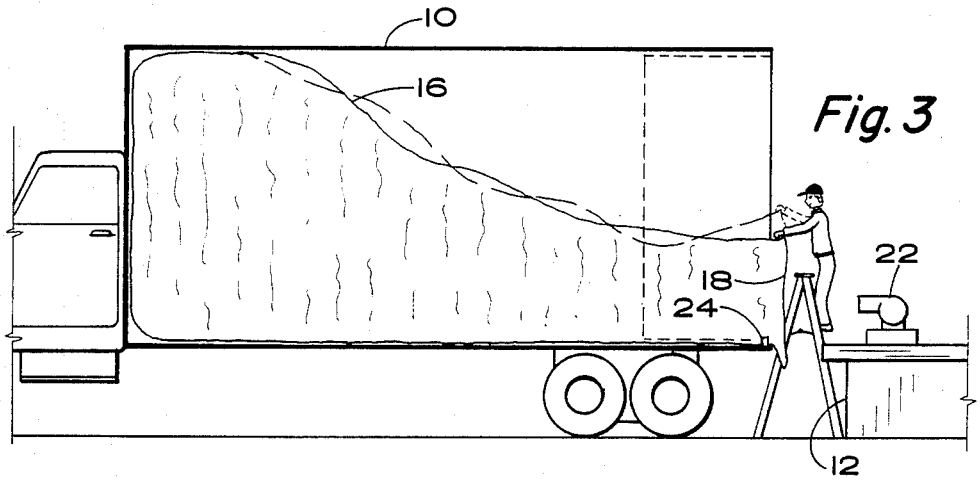

Having secured the lower edge of the liner bag 16 to the doorway 20, the blower is then turned on and a gentle stream of air is directed into the bag 16. The air is selectively directed to the front of the trailer 10 (see FIG. 3) such that the liner 16 inflates to the ceiling of the trailer in the front portion of the trailer first. The blower 22 continues to gradually fill the liner 16 from the front of the trailer to the rear of the trailer. To assist in this critical inflation step, tension is selectively applied to the upper surface of the liner 16 by manually pulling downward and outward on the upper edge of the liner bag opening 18. This particular step is considered novel and critical in that experience indicates that if the liner bag is not inflated from the front to the rear, thus systematically displacing any trapped air behind the bag, the entire bag will tend to exit the trailer during the inflation step. By applying sufficient tension to the upper surface of the liner as it inflates, the air between the liner and the inside of the trailer will be forced out of the trailer.

In view of the above step, it is also critical that the dimensions of the liner bag be selected such that it will fit the entire interior of the trailer. Preferably, the liner bag is a cylindrically shaped bladder having a diameter slightly greater than the larger of the width or height of the inside of the trailer.

Figure 4:
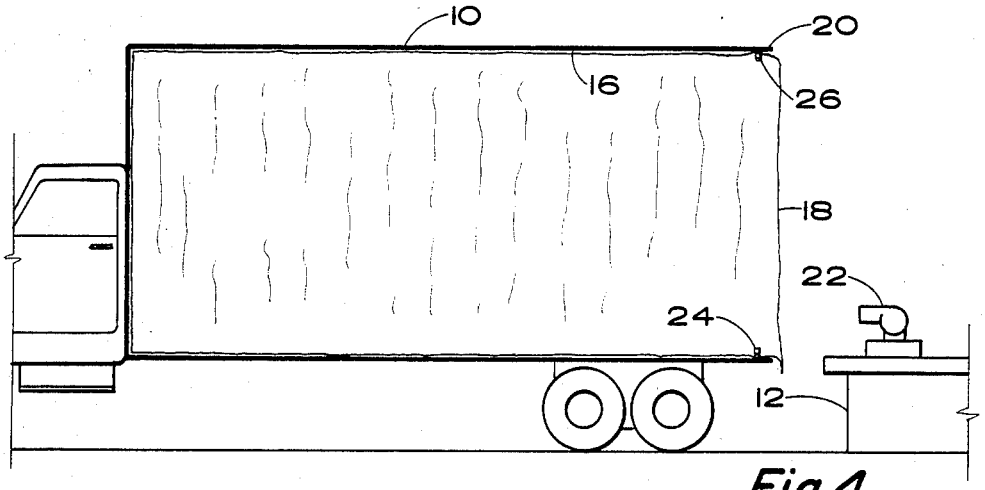
FIGS. 4 and 5 illustrate the free standing waterproof liner fully installed and ready for loading of the trailer.
Figure 5:
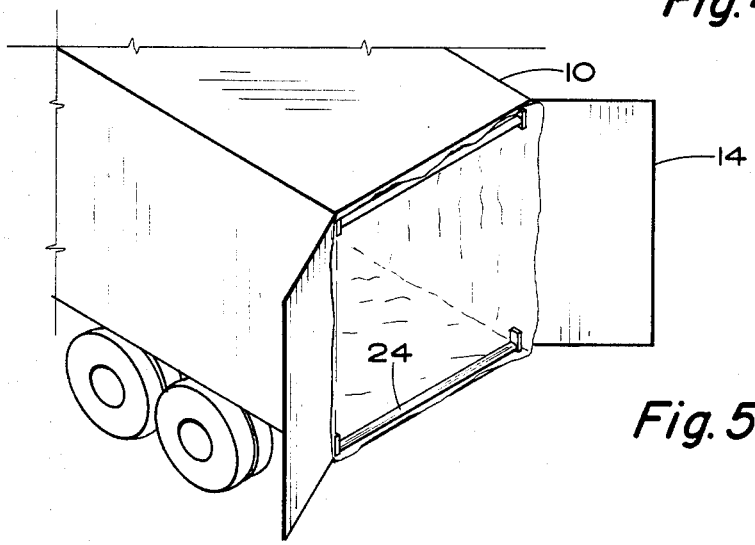
Figure 6:
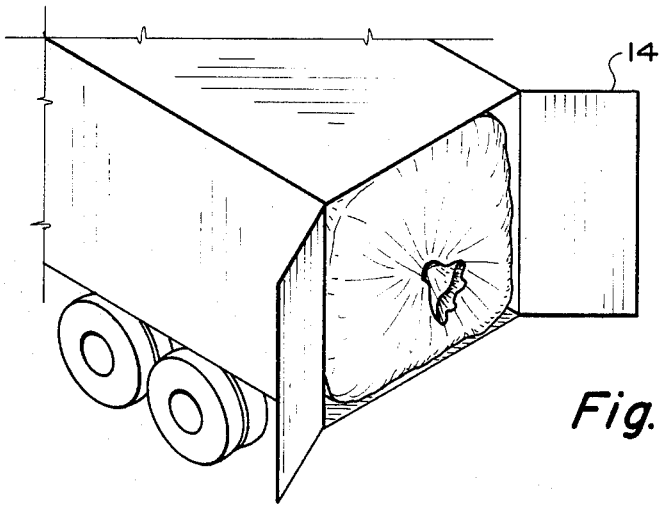
FIG. 6 illustrates the moisture proof liner sealed around the cargo of a loaded trailer.

As illustrated in FIGS. 4 and 5, once the bag liner 16 is fully inflated, the opening 18 of the liner is attached to the perimeter of the trailer doorway 20. In the specific embodiments of the drawing, the tension bars 24 and 26 are used to temporarily seal the bag opening 18 at the trailer doorway 20. However, as previously stated, any temporary sealing or fastening means or method well known in the art can be employed to temporarily attach the liner to the doorway. The trailer is now ready to be loaded in a conventional manner. During loading, the blower preferably remains in operation. However, the liner once correctly inflated and sealed at the trailer doorway tends to remain in an inflated state for a considerable period of time, even without air assist. After loading the cargo into the trailer, the blower is turned off and the excess liner material is wrapped around the end of the cargo and sealed such as to insure a moisture proof enclosure surrounding the entire cargo (see FIG. 6).

As previously stated, the bag liner or inflatable protective bladder of the present invention is preferably a thin polymeric film bag of sufficient size to make contact upon inflation with the entire interior of the enclosure. It is contemplated that the plastic bag can be made of any of the conventional film grade polymeric compositions, including by way of example, but not limited thereto, polyolefins such as high density polyethylene, low density polyethylene, polypropylene and blends thereof, film grade vinyl polymers as well as natural polymeric materials such as cellulose type films. The class of polymeric film compositions that has been found to be particularly useful in the manufacturing of the plastic liner are the film grade blends of high density polyethylene with low density polyethylene. The bag is contemplated as being capable of being fabricated from a series of polymeric strips or sheets which are adhesively bonded or heat sealed along longitudinal seams to each other to form the bag. The bag can also be extruded in a single sheet or cylindrical tube provided an extrusion dye of sufficient size is available. If longitudinal pieces are to be sealed together to make the bag, the use of a thicker film for the floor, along with color pigmentation and non-slip additives to identify the floor versus the sidewalls can be incorporated into the construction of the bag liner. Experience indicates that when polyolefins such as polyethylene blends are used, the bag can be made out of a relatively thin film. A 2 mil polyethylene film has been successfully tested under conventional interstate commerce transportation conditions and has proved to be quite adequate for purposes of this invention. In fact, such liners have exhibited the ability to be reused if desired, but the inexpensive nature of the thin film would not necessitate reuse and is highly suggestive of disposing of the bag after one shipment.

The actual time, effort and equipment employed to install the bag liner is surprisingly nominal. Under conventional semi-trailer dock loading procedures and environment, the time required to actually inflate the liner bag has been measured to be as short as 30 seconds. The procedure employed during this observation was essentially as illustrated in the drawing and involved air movement equivalent to that produced by a conventional air blower or air fan.

The use of polyolefin film bag liners of the present invention is particularly useful to protect tobacco products, paper products, foods and drugs, as well as other highly moisture sensitive cargo. The bag liners are also useful in shipping cargo that require ultra clean or an uncontaminated environment and could also be readily adapted to be used to maintain an inert vapor phase or gaseous environment. It is envisioned that the method of installing the film liner can be advantageously employed in semi-trailers, cargo containers or generally any equivalent transportation or storage facility wherein an inexpensive, throw-away plastic liner would be appropriate.

Having thus described and exemplified the preferred embodiments of the present invention with a certain degree of particularity, it is manifest that many changes can be made within the details of operation, operating parameters, and implementation of the steps without departing from the spirit and scope of this invention. Therefore, it is to be understood that the invention is not limited to the embodiments set forth herein for purposes of exemplification, but is to be limited only by the scope of the attached claims, including the full range of equivalents to which each step thereof is entitled.

I claim:

1. A method of installing a continuous film liner within an enclosed cargo trailer such as to serve as a moisture barrier protecting the cargo to be shipped within said trailer comprising the steps of:

(a) providing an enclosed cargo trailer having doors at one end wherein said trailer is intended to be used to ship moisture sensitive cargo;

(b) providing a deflated moisture proof film bag of dimensions slightly in excess of the interior dimensions of said trailer and having an opening in said film bag that corresponds to the doorway of said trailer;

(c) placing said deflated bag within said empty trailer such that the opening of said bag is located at the doorway of said trailer prior to placing cargo within said trailer;

(d) temporarily attaching the lower edge of said bag opening to the lower edge of said doorway such that said bag is directed into the interior of said trailer;

(e) physically restraining the upper edge of said bag opening from making contact with the upper portion of said trailer and trailer doorway;

(f) directing and blowing a stream of air into said bag opening while physically restraining the upper edge of said bag opening according to step (e) such that said air is directed towards the back end of said trailer;

(g) maintaining sufficient tension on said upper edge of said bag opening while said blowing of air into said bag continues such as to direct all of said air to the far end of said trailer thus causing the inflating bag to make continuous contact with the interior of said trailer from the frontmost portion of said trailer forward to the trailer doorway, thus displacing the air between the inflating bag and the interior of the trailer out the trailer doorway; and (h) temporarily attaching the bag opening of the inflated bag to the perimeter of the trailer doorway such as to allow cargo to be loaded within the trailer and inflated liner.

2. A method of installing a continuous film liner within an enclosed cargo trailer according to claim 1 further comprising the steps of:

(a) filling the trailer and bag with moisture sensitive cargo;

(b) detaching the film bag from the trailer doorway; and (c) sealing the film bag around the cargo such as to protect the cargo during shipment.

3. A method of installing a continuous film liner within an enclosed cargo trailer according to claim 1 wherein the film bag is a cylindrical disposable polyolefin bag of effective diameter slightly greater than the larger of the interior height or width of said cargo trailer.

4. A method of installing a continuous film liner within an enclosed cargo trailer according to Claim 2 wherein the film bag is a cylindrical disposable polyolefin bag of effective diameter slightly greater than the larger of the interior height or width of said cargo trailer.

5. A method of installing a continuous film liner within an enclosed cargo container such as to serve as a moisture barrier protecting the cargo to be shipped within said container comprising the steps of:

(a) providing an enclosed cargo container having doors at one end wherein said container is intended to be used to ship moisture sensitive cargo;

(b) providing a deflated moisture proof film bag of dimensions slightly in excess of the interior dimensions of said container and having an opening in said film bag that corresponds to the doorway of said container;

(c) placing said deflated bag within said empty container such that the opening of said bag is located at the doorway of said container prior to placing cargo within said container;

(d) temporarily attaching the lower edge of said bag opening to the lower edge of said doorway such that said bag is directed into the interior of said container;

(e) physically restraining the upper edge of said bag opening from making contact with the upper portion of said container and container doorway;

(f) directing and blowing a stream of air into said bag opening while physically restraining the upper edge of said bag opening according to step (e) such that said air is directed towards the back end of said container;

(g) maintaining sufficient tension on said upper edge of said bag opening while said blowing of air into said bag continues such as to direct all of said air to the far end of said container thus causing the inflating bag to make continuous contact with the interior of said container from the frontmost portion of said container forward to the container doorway, thus displacing the air between the inflating bag and the interior of the container out the container doorway; and (h) temporarily attaching the bag opening of the inflated bag to the perimeter of the container doorway such as to allow cargo to be loaded within the container and inflated liner.

6. A method of installing a continuous film liner within an enclosed cargo container according to claim 5 further comprising the steps of:

(a) filling the container and bag with moisture sensitive cargo;

(b) detaching the film bag from the container doorway; and (c) sealing the film bag around the cargo such as to protect the cargo during shipment.

7. A method of installing a continuous film liner within an enclosed cargo container according to claim 5 wherein the film bag is a cylindrical disposable polyolefin bag of effective diameter slightly greater than the larger of the interior height or width of said cargo container.

8. A method of installing a continuous film liner within an enclosed cargo container according to claim 6 wherein the film bag is a cylindrical disposable polyolefin bag of effective diameter slightly greater than the larger of the interior height or width of said cargo container.

* * * * *